US005890043A

United States Patent [19]

Uehara

[11] Patent Number: 5,890,043

[45] Date of Patent: Mar. 30, 1999

[54] IMAGE FORMING APPARATUS CAPABLE OF HEATING A TONER IMAGE ON AN INTERMEDIATE TRANSFER MEMBER AND METHOD THEREFOR

[75] Inventor: Yasuhiro Uehara, Nakai-machi, Japan

[73] Assignee: Fuji Xerox Co., Ltd., Tokyo, Japan

[21] Appl. No.: 908,962

[22] Filed: Aug. 8, 1997

[30] Foreign Application Priority Data

Aug. 13, 1996 [JP] Japan ..... 8-231511

[51] Int. Cl.[6] ..... G03G 15/16; G03G 15/20

[52] U.S. Cl. ..... 399/307; 430/124

[58] Field of Search ..... 399/307, 308, 399/302, 328; 430/124, 126

[56] References Cited

U.S. PATENT DOCUMENTS

| | | | |
|---|---|---|---|
| 4,542,978 | 9/1985 | Tarumi et al. | 399/308 |
| 4,992,833 | 2/1991 | Derimiggio | 399/308 |
| 5,629,761 | 5/1997 | Theodoulou et al. | 399/307 |

FOREIGN PATENT DOCUMENTS

| | | |
|---|---|---|
| 46-41679 | 12/1971 | Japan . |
| B2 57-20632 | 4/1982 | Japan . |
| A 57-163264 | 10/1982 | Japan . |
| B2 58-36341 | 8/1983 | Japan . |
| B2 64-1027 | 1/1989 | Japan . |
| 2-190870 | 7/1990 | Japan . |

*Primary Examiner*—Joan Pendegrass
*Attorney, Agent, or Firm*—Oliff & Berridge, PLC

[57] ABSTRACT

An image forming apparatus and an image forming method for transferring and fixing is capable of securely transferring and fixing a toner image onto a recording medium after transferring the toner image formed on an image carrier onto an image transfer member with small energy consumption for high-speed printing. In this apparatus an endless belt-like intermediate transfer member facing to four image forming units is tensioned by a heating roll and the like, and a pressing member for pressing the recording medium against the intermediate transfer member in the most downstream portion of a contact area with the heating roll in the rotational direction of the intermediate transfer member. The toner image on the intermediate transfer member is heated by the heating roll at specified temperatures, and the toner melted is brought into tight contact with the recording medium at normal temperatures for transferring and fixing. The temperature of toner at the outlet of the pressure-contact portion with the pressing member is caused to lower below the toner softening point temperature. At this time, the recording medium serves as a cooling member.

20 Claims, 6 Drawing Sheets

| | |
|---|---|
| ——— | PRESENCE OF ELASTIC MEMBER (THERMAL INSULATING LAYER) |
| - - - - - | ABSENCE OF ELASTIC MEMBER (THERMAL INSULATING LAYER) |

| | |
|---|---|
| CORE | ELASTIC BODY/CORE INTERFACE |
| THERMAL INSULATING ELASTIC LAYER | INTERMEDIATE MEMBER/ELASTIC BODY INTERFACE |
| INTERMEDIATE TRANSFER MEMBER | TONER/INTERMEDIATE MEMBER |
| TONER | SHEET/TONER INTERFACE |
| SHEET | SHEET BACK |

IMAGE FORMING APPARATUS CAPABLE OF HEATING A TONER IMAGE ON AN INTERMEDIATE TRANSFER MEMBER AND METHOD THEREFOR

BACKGROUND OF THE INVENTION

1. Field of the Invention

The present invention relates to an image forming apparatus and an image forming method using an electrophotographic process, and more particularly to an image forming apparatus and an image forming method for transferring and fixing, after a toner image formed on an image carrier is transferred onto an intermediate transfer member, the toner image on the intermediate transfer member onto a recording medium to obtain a recorded image.

2. Description of the Related Art

As a conventional image forming apparatus, there has been known an image forming apparatus in which toner on an image carrier is primarily transferred onto an intermediate transfer member having a parting property and a toner image on the intermediate transfer member is melted on a recording medium by heating and pressing means for fixing simultaneously with secondary transfer. As this heating and pressing means, a heating roller and a pressing roller which are brought into pressure contact through the intermediate transfer member are known. Toner on the intermediate transfer member is melted at a pressure-contact portion between the two by the heating roll to cause the toner to percolate through the recording medium, and the recording medium is separated from the intermediate transfer member by taking advantage of the parting effect of the intermediate transfer member.

In such an image forming apparatus, in order to transfer a toner image on the intermediate transfer member onto a recording medium and fix it at the same time, there are various severe conditions, and it is considerably difficult to attain transfer and fixing of a good toner image. To this end, as means for improving the transfer and fixing of toner images, there have been proposed techniques described in, for example, Japanese Published Examined Patent Application Nos. Sho 46-41679 (1971), 57-20632 (1982), 58-36341 (1983), and 64-1027 (1989),and Japanese Published Unexamined Patent Application No. Sho 57-163264 (1982).

The technique described in the Japanese Published Examined Patent Application No. sho 46-41679 is to heat a recording medium without heating a toner image on an intermediate transfer member to melt the toner image by the heat of the recording medium for transferring and fixing on the recording medium.

The technique described in the Japanese Published Examined Patent Application Nos. sho 57-20632 and 58-36341 are to selectively heat the toner on an intermediate transfer member to its fusion temperature by radiation heating means without heating the recording medium, and to bring the toner image on the intermediate transfer member into contact with the recording medium for transferring and fixing.

The technique described in the Japanese Published Unexamined Patent Application No. sho 57-163264 is to previously heat the intermediate transfer member and the toner image transferred thereon, and to place the two in close contact with each other in a state in which the recording medium has been heated for transferring and fixing the toner image on the recording medium.

The technique described in the Japanese Published Examined Patent Application No. Sho 64-1027 is to preliminarily heat toner at this side of a nip portion (transfer fixing area) in which the toner image on the intermediate transfer member is urged against the recording medium. More specifically, a belt-like intermediate transfer member is wound around the heating roll by 90° or more to preliminarily heat the toner by the utilization of the heat of the heating roll at this side of the nip portion with the recording medium for raising the toner temperature to near the fusion temperature of the toner. Thereafter, in the nip portion, the toner is further heated and fused to transfer the toner image onto the recording medium and fix it.

The conventional technique as described above, however, has the following problems.

The technique described in the Japanese Published Examined Patent Application No. Sho 46-41679 is desirable in terms of such points that the intermediate transfer member is not likely to be overheated, but the image carrier can be prevented from being thermally affected, but the utilization of heat is low, and a considerably large amount of thermal energy must be applied to a recording medium consisting of ordinary sheet. Further, in the case of transferring and fixing a toner image at high speeds, it is necessary to further apply a large amount of thermal energy to the recording medium, and as a result, the technique has a disadvantage that the consumption energy increases and when the recording medium is not smoothly fed, but jam is caused, combustion is very likely to be caused.

Also, in the technique described in Japanese Published Unexamined Patent Application Nos. Sho 49-78559 and 50-107936, this will be inferior to conductive heating means such as a heating roll in actual thermal efficiency because radiation heating is used as means for selectively heating only toner. Also, since most of thermal energy absorbed by toner is conducted to the intermediate transfer member at lower temperatures while it shifts from a radiation heating area to a transfer fixing area in which it is brought into contact with the recording medium, there is a disadvantage that the toner will have to be heated that much in excess in advance, thus lowering the total thermal energy efficiency. Moreover, since the radiation heating means is used, a paper sheets is likely to be burnt when jam occurs.

On the other hand, the technique described in the Japanese Published Unexamined Patent Application No. Sho 57-163264 has an advantage that the temperature of an intermediate transfer member can be set to be low because the three parties of the intermediate transfer member, toner and recording medium are heated together. Also, there is little heat flow between a toner image on the intermediate transfer member and the recording medium at the pressure-contact portion, the deteriorated fluidity of the toner is low accordingly, and the toner sufficiently percolates through the recording medium to be transferred from the intermediate transfer member. Since, however, the toner temperature when separated from the intermediate transfer member is higher than the toner softening point temperature and the toner is in a fluid state, there is a tendency that the toner is scattered and is easily offset to the intermediate transfer member. Also, since it is necessary to heat the three parties of the intermediate transfer member, toner and recording medium together, the total consumption energy will become great. In addition, there is a problem that the heat is conducted to the image carrier side by means of the rotational movement of the intermediate transfer member heated by the heating roll and the temperature in its vicinity rises to cause obstruction to the charging function. If an attempt is made following such a mechanism to prevent the heat of the intermediate transfer member from being conducted to the image carrier side, a considerably large cooling equipment will be required to increase the cost of the apparatus.

In the technique described in the Japanese Published Examined Patent Application No. Sho 64-1027, although it is possible to make the set temperature of the heating roll low since the toner is preliminarily heated at this side of the nip portion (transfer fixing area), the total consumption energy will become great in the same manner as the above-described conventional examples because the toner and recording medium are re-heated in the transfer fixing nip portion.

SUMMARY OF THE INVENTION

The present invention has been achieved in the light of the above-described problems, and its object is to provide an image forming apparatus and an image forming method capable of securely transferring and fixing a toner image on an intermediate transfer member onto a recording medium and of high-speed printing with less total consumption energy and limited electric power.

In order to solve the above-described problems, according to the present invention, in an image forming apparatus and an image forming method for primarily transferring a toner image formed on an image carrier onto an intermediate transfer member, and for secondarily transferring this toner image onto a recording medium for fixing, a heating member is so arranged as to come into contact with the inner peripheral surface of an endless belt-like intermediate transfer member, and the toner image on the intermediate transfer member is heated in a heating area in which it comes into contact with the heating member so that the temperature of the toner image exceeds 1.5 times toner softening point temperature (heating process). Further, in the most downstream portion of a contact area between the heating member and the intermediate transfer member in the rotational direction thereof, there is provided a pressing member which brings a recording medium at normal temperatures to be fed between the intermediate transfer member and the pressing member into pressure contact with the intermediate transfer member so as to transfer and fix the toner image onto the recording medium in an area in which the recording medium and the intermediate transfer member are brought into pressure contact with each other (transferring fixing process). At this time, a period of time during which the recording medium passes the pressure-contact portion is set so that the toner temperature at the outlet of the transfer fixing area of the toner image is not more than the toner softening point temperature.

A first feature of such an image forming apparatus and image forming method is that the thermal energy for transferring and fixing applied to the intermediate transfer member and toner is applied only in an area (heating area) until the intermediate transfer member comes into contact with recording medium since the intermediate transfer member and the heating member are actually brought into contact with each other. In a transferring and fixing area in which the toner image is brought into pressure contact with the recording medium, heat conduction from the heating member to the intermediate transfer member is hardly caused even if the heating member is in contact with the intermediate transfer member, and the transferring and fixing are carried out only with the thermal energy accumulated in the intermediate transfer member and the toner.

Also, a second feature is that toner is transferred and fixed on the recording medium in a moment by means of the thermal energy and the contacting force possessed by the toner itself has when the recording medium at normal temperatures passes the pressure-contact portion in the transfer fixing area, and that thereafter, the recording medium itself lowers the toner temperature to a temperature not more than the toner softening point temperature while it is taking heat away from the toner and the intermediate transfer member to the outlet of the pressure-contact portion. Since the recording medium which has taken heat away is discharged from the apparatus thereafter, no heat is accumulated within the apparatus. In this case, the recording medium is to serve as a cooling member for the intermediate transfer member.

In the above-described image forming apparatus, in order to carry out sufficient transfer and fixing only with energy imparted by the heating member, it is necessary to heat at least the intermediate transfer member and the toner thereon in advance to a temperature not less than 1.5 times the toner softening point temperature. To this end, such structure is required that the heating area in which the heating member and the intermediate transfer member come into contact with each other is taken as wide as possible and a period of time (referred to as duel time) during which the intermediate transfer member passes the heating area is made to be long. For example, if the duel time is 300 milli-second when the intermediate transfer member has a thickness of not more than 40 $\mu$m, the temperature of the intermediate transfer member can be made to be substantially equal to that of the surface of the heating member. In this respect, if the toner temperature is not more than 1.5 times the softening point, when it comes into contact with the recording medium at normal temperatures in the transfer fixing area, the toner is rapidly cooled, audits fluidity deteriorates. Therefore, the toner is not completely transferred onto the recording medium, but partially remains while adhering to the intermediate transfer member. This leads to contaminated image carrier and an offset phenomenon. Also, the toner temperature is further preferably heated so that it becomes 1.5 times and over to 2.5 times inclusive. the toner softening point for the following reason. When the toner temperature exceeds 2.5 times the softening point, the toner will not be sufficiently cooled even if it comes into contact with the recording medium at normal temperatures, but since the toner is still in a melted state during peeling, a phenomenon in which the toner offsets to the intermediate transfer member comes to occur. Also, the heat-resistant temperature required of the intermediate transfer member becomes higher, and the width of the recording medium for selection becomes narrower. From the foregoing, in order to realize sufficient transfer fixing property and anti-offset characteristics, the optimum toner heating temperature is 1.5 times to 2.5 times the toner softening point temperature.

Next, in order to make the toner temperature at the outlet of the transfer fixing area, in which the toner image and the recording medium are brought into pressure contact with each other, not more than the toner softening point temperature, it is necessary to make the dwell time, during which the recording medium passes the pressure-contact portion with the intermediate transfer member, short, and to cause the recording medium to pass the pressure-contact portion before the temperature change is transferred to the heating member as shown in FIG. 5A. Since the temperature on the inner surface of the intermediate transfer member is the same as the surface temperature of the heating member to the outlet of the pressure-contact portion by so doing, any unnecessary heat conduction to the intermediate transfer member will not be conducted, having the great effect on lowering the temperatures of the toner and the intermediate transfer member during peeling. The duel time, during which no heat conduction to the intermediate transfer member is conducted in this transfer fixing area, also depends upon the thickness of the intermediate transfer member, and in the case of the intermediate transfer member having a thickness of 10 μm to 50 μm, if the duel time is 0.03 second to 0.007 second or less, no heat transfer to the intermediate transfer member is actually caused. This corresponds to a nip width of 0.9 to 2.1 mm when the transfer fixing speed is 300 mm/s.

More specifically, according to the above-described conditions, the thermal energy possessed by the intermediate transfer member and the toner in the heating area provides an amount sufficient to transfer and fix the toner, and thereafter, heat is taken away from the toner and the intermediate transfer member by the recording medium at normal temperatures in the transfer fixing area to cool the toner to not more than the softening point temperature. At this time, when the toner melted by being heated at 1.5 times and over to 2.5 times inclusive. the toner softening point is urged against the recording medium at normal temperatures, the fluidity of the toner somewhat deteriorates in an instant, but the transfer fixing property does not become insufficient because it has been properly melted from the beginning. To this end, the toner is cooled and hardened while percolating through the fiber of the recording medium to complete the transfer and fixing. At this time, since the toner temperature at the outlet of the pressure-contact portion becomes not more than the toner softening point temperature, the toner cohesive power increases so that the toner does not offset to the intermediate transfer member when the recording medium is separated from therefrom.

Now, the structure of each member of the above-described image forming apparatus will be described in detail.

The above-described heating member preferably takes a construction including a heating source arranged within a cylindrical member and a thermal insulating elastic body layer formed on the outer peripheral surface of the cylindrical member. Since the thermal insulating elastic body layer is thus interposed between the intermediate transfer member and the heating source, heat conduction from the heating source to the intermediate transfer member is suppressed. Therefore, as shown in FIG. 5B, it becomes possible to cool the toner and the intermediate transfer member in a shorter period of time without causing any heat conduction from the heating member than a case where no thermal insulating elastic body layer exists, thus making it possible to securely lower the toner temperature at the outlet of the transfer fixing area to not more than the toner softening point temperature.

Also, by the formation of the thermal insulating elastic body layer on the surface of the heating member, it is possible to exert pressure so that the recording medium is uniformly brought into tight contact with the toner image by utilizing the elastic deformation of the thermal insulating elastic body layer, thus obtaining uniform image quality without density unevenness. The thickness of such a thermal insulating elastic body layer is preferably not less than 100 μm when an intermediate transfer member of 10 μm to 40 μm is used.

The above-described intermediate transfer member has preferably a thermal capacity per unit area being smaller than half the thermal capacity per unit area of the recording medium. This makes it possible to cool the toner and intermediate transfer member heated within a shorter period when the toner image on the intermediate transfer member comes into contact with the recording medium at normal temperatures in the transfer fixing area. The lower limit value of the thermal capacity of the intermediate transfer member, namely the lower limit value of the thickness is determined by the mechanical strength. When the thickness of the intermediate transfer member is below 10 μm, rumples or turned-up ends easily occur, and therefore, the thickness of at least 10 μm is practically used. Also, when it is thicker than 40 μm, the intermediate transfer member becomes difficult to be cooled, which causes a trouble in cooling the toner image in a short time. Accordingly, the thickness of the intermediate transfer member is preferably 10 μm and over to 40 μm inclusive., namely the thermal capacity of the intermediate transfer member is preferably 1/10 and over to ½ inclusive. of the thermal capacity of the recording medium.

For the toner applicable to the present invention, either one of wax-filled oilless toner frequently used for conventional blank-and-white copying apparatuses and sharp-melt toner used for color copying apparatuses can be used, but the feature of the present invention can be further brought out particularly by a combination with such toner for color copying apparatuses as described below.

On forming a color image or a full color image, it is possible to enlarge the color reproduction range of a copying apparatus and to satisfactorily obtain a color copy faithful to multi-color or full color images of document by the use of sharp-melt toner. For the color toner, toner using, for example, polyester resin is preferable as sharp-melt binding resin in consideration of the color developing property and the fixing characteristics. Also, toner having a softening point at low temperatures such as 75° to 150° C., preferably 80° to 125° C. is preferable. The softening point of the toner according to the present invention is determined by the following measuring method.

When isokinetic temperature rising is effected at a rate of 6° C./minute at an initial set temperature of 70° C. after a preheating time of 300 seconds by applying an extrusion load of 20 kg with a die (nozzle) having a diameter of 0.2 mm and a thickness of 1.0 mm using a flow tester Model CFT-500A (manufactured by Shimadzu Seisakusho Ltd.), an amount of toner plunger lowering-temperature curve (hereinafter, referred to as softening Sth order curve) to be prepared is determined. For specimen toner, fine powder obtained by precisely weighing 1 to 3 g is used, and the plunger sectional layer has an area of 1.0 $cm^2$. The softening Sth order curve becomes such a curve as shown in FIG. 7. As isokinetic temperature rising is conducted, the toner is gradually heated to start the effluence (plunger lowering A→B). When the temperature is further raised, the toner, which has entered a melted state, greatly flows out (B→C→D), and the plunger lowering stops to terminate (D→E). The height H of the softening Sth order curve shows a total amount of effluence, and the temperature $T_o$ corresponding to point C at a height of H/2 indicates the softening point of the specimen (for example, toner or resin).

It can be determined by measuring the apparent melting viscosity of toner or binding resin whether or not the toner and binding resin has sharp-melt property. Toner having the sharp-melt property in the present invention is toner which satisfies conditions that $T_1$=80° to 140° C., and that $T_2-T_1$= 5° C. to 20° C. assuming temperature at which the apparent melting viscosity indicates $10^3$ Pa.s to be T1, and temperature at which the apparent melting viscosity indicates $5\times10^2$ Pa.s to be $T_2$. The sharp-melt resin having these temperature-melting viscosity characteristics is characterized by causing viscosity deterioration very sharply by being heated. Such viscosity deterioration causes proper mixing between top toner layer and bottom toner layer on the intermediate transfer member, further rapidly increases the transparence of the toner layer itself, and causes satisfactory tone reduction mixing.

Also, since the fluidization of the sharp-melt toner causes air contained in the powder to escape to increase the thermal conductivity within the toner layer, it is possible to melt the entire toner layer in a short heating time even when each color toner is laid one on top of another, which becomes effective particularly for an image forming apparatus according to the present invention. Further, color toner having such sharp-melt property has great affinity, and easily offsets during fixing, but no offset occurs at all because peeling is made from the intermediate transfer member at temperatures not more than the softening point according to the present invention.

The above-described pressing member is preferably supported in such a manner that when it is urged against the heating member through the intermediate transfer member, elastic deformation is caused in the thermal insulating elastic body layer on the heating member. This causes compression deformation to the elastic body layer on the heating member at the pressure-contact portion with the pressing member, and further micro slip occurs on the recording medium when the elastic body layer deformed is restored downstream of the pressure-contact portion. Therefore, the recording medium will be easily separated from the intermediate transfer member.

Also, the pressing member is composed of a pressing rotatable member consisting of a cylindrical member having a uniform cross-section axially, for being pressed against the heating member, and a pressing member inserted inside the pressing rotatable member, and supported on both ends thereof, for pressing the pressing rotatable member against the heating member. At this time, the pressing member has a larger diameter at the central portion thereof than a diameter at both ends thereof in such a manner that the contacting force between the pressing rotatable member and the heating member is substantially uniform axially. In a conventional two-roll system for pressing the heating member against the pressing roll, it shows a tendency in which the central portion of the heating member deflects into a recessed shape to make the pressure-contact portion ununiform. According to the present invention, however, the pressing member is caused to be pressed against the heating member through the pressing rotatable member, whereby the deflection directions of the heating member and the pressing member can be made to be the same direction even if the central portion of the heating member deflects in a concave shape. Accordingly, the pressing rotatable member has a shape to follow the deflection curve of the heating member, thus making it possible to make the shape of the pressure-contact portion substantially uniform axially, and to maintain the contacting force substantially uniform. Therefore, it is possible to prevent defective fixing from occurring, and to prevent rumples on the intermediate transfer member and the recording medium because the speed of the pressing rotatable member on the circumferential surface becomes substantially uniform axially.

DETAILED DESCRIPTION OF THE PREFERRED EMBODIMENTS

Hereinafter, the description will be made of an embodiment of the present invention with reference to the drawings.

Figure 1:
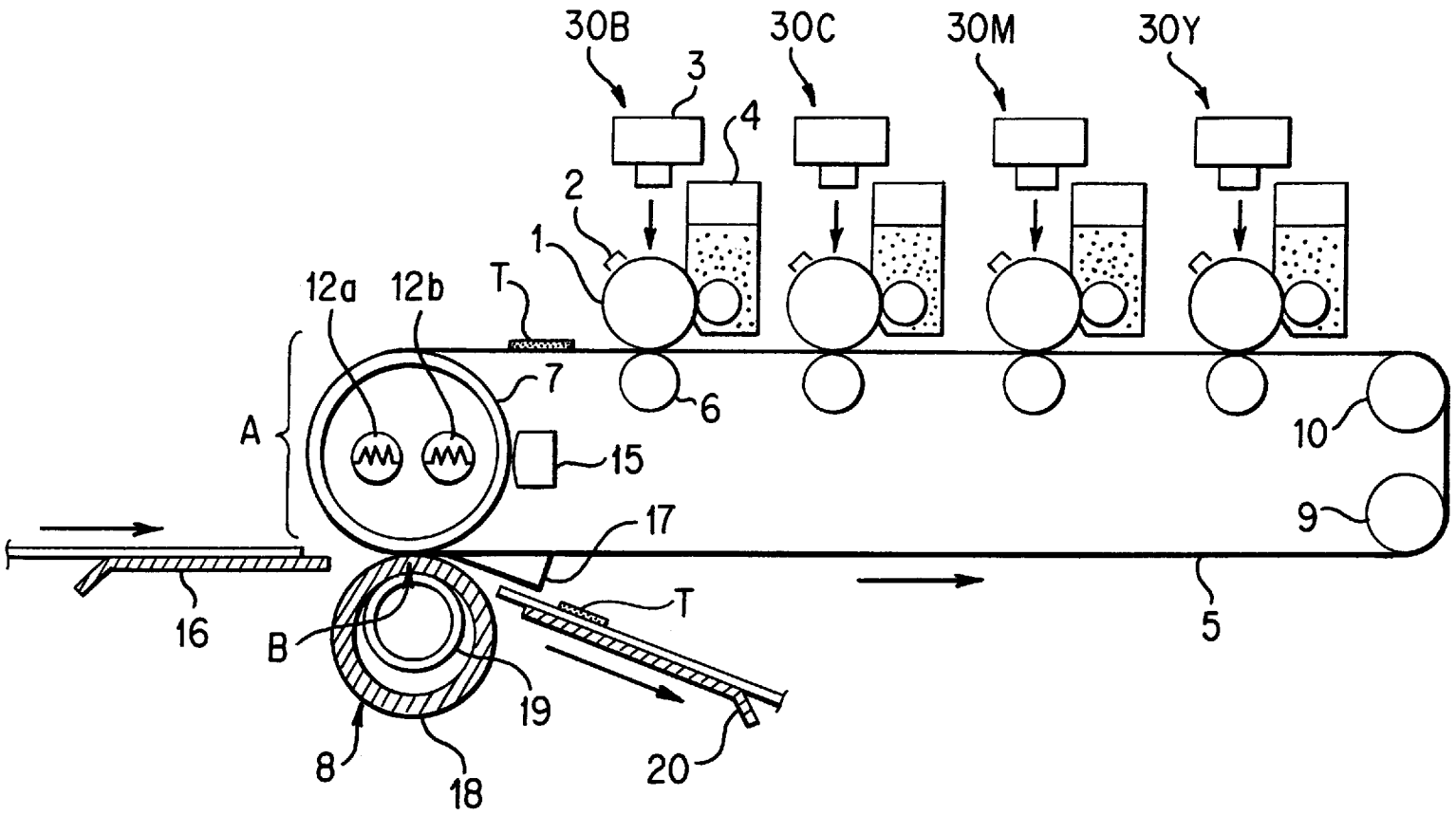
FIG. 1 is a schematic structural view showing an image forming apparatus according to an embodiment of the present invention.

FIG. 1 is a schematic structural view showing an image forming apparatus according to an embodiment of the present invention.

This image forming apparatus has an endless belt-like intermediate transfer member 5 so supported as to allow its peripheral surface to rotate, and at locations facing to the intermediate transfer member 5, there are arranged four image forming units 30Y, 30M, 30C and 30B for forming toner images of yellow, magenta, cyan and black. Each image forming unit has an image carrier 1, on the surface of which an electrostatic latent image is formed, and is equipped, around each image carrier 1, with a charging unit 2 for uniformly charging the surface of the image carrier 1, an exposure unit 3 for irradiating the surface of the image carrier with image light to form a latent image, a developing unit 4 for selectively transferring toner onto the latent image formed on the image carrier to form a toner image, and a transfer roll 6 for transferring the toner image on the image carrier onto the intermediate transfer member 5.

Inside the intermediate transfer member 5, there are arranged a driving roll 9, a tension roll 10, and a heating roll 7 for heating a toner image on the intermediate transfer member, and the intermediate transfer member 5 is so tensioned by these as to be rotated. In the most downstream portion of a contact area with the heating roll 7 in the rotational direction of the intermediate transfer member 5, there are provided a pressing member 8 for pressing the intermediate transfer member 5 against the heating roll 7, a paper guide 16 for feeding a recording medium into a pressure-contact portion between the pressing member 8 and the intermediate transfer member 5, a separating claw 17 for separating the recording medium which passed the pressure-contact portion, and a recording medium feeding path 20 for feeding the recording medium.

The intermediate transfer member 5 is prepared by forming a surface layer having good parting property from toner on the surface of an endless belt-like base, and is arranged to rotate and move at a speed of 300 mm/s in the arrow direction shown in the figure by the rotation of the driving roll 9. The intermediate transfer member 5 requires heat-resisting property, and as the base, there is used film of polyester, polyimide, polyamide-imide, polyacrylate, polyether-imide, polyether-sulfone, polyether-keton, polyparabanic acid or the like. In this example, there is used a member prepared by coating a base of polyamide 800 mm in perimeter, 320 mm in width and 12 $\mu$m in thickness with PFA fluorine resin having good parting property in thickness of 3 $\mu$m. Also, in consideration of the electrostatic transfer performance, carbon black is mixed in the base to increase the resistivity to $10^{10}$ Ωcm. The thermal capacity of the intermediate transfer member 5 is 1.35 joule/°C. per area of size A4, which corresponds to about ⅕ the thermal capacity of the recording medium.

Figure 2:
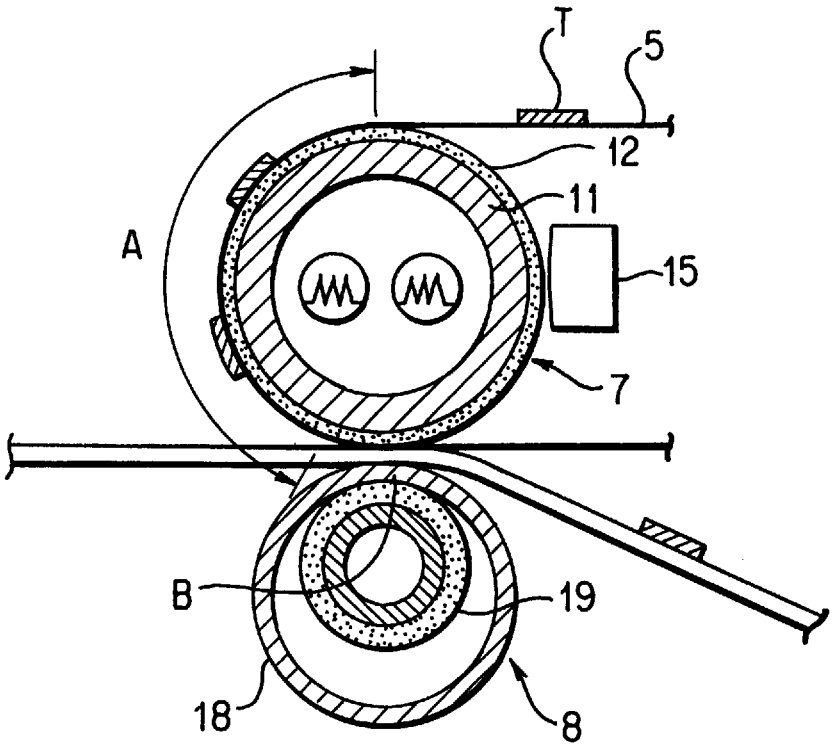
FIG. 2 is a schematic structural view showing a heating roll and a pressing member for use with the image forming apparatus.

The heating roll 7 is located downstream of the image forming units 30 in the rotational direction of the intermediate transfer member 5, and as shown in FIG. 2, a heating area A is formed by the heating roll being wound by the intermediate transfer member 5 by 180 degrees. The heating roll 7 incorporates heating sources 12*a* and 12*b* inside a cylindrical mandrel 11, and a thermal insulating elastic body layer 13 is formed on the peripheral surface of the cylindrical mandrel 11. Also, for the thermal insulating elastic body layer 13, there is used a heat-resistant elastic body having a thickness of not less than 50 $\mu$m and thermal conductivity of $0.4\times10^{-3}$cal/°C.sec.cm and over to $2.5\times10^{-3}$cal/°C.sec.cm incl. In this example, as the mandrel 11, there is used a hollow member made of steel having a diameter of 49.5 mm and thickness of 0.4 mm, and on its peripheral surface, a silicone rubber layer having thickness of 250 $\mu$m is formed. Also, as the heat sources 12*a* and 12*b*, two types: 650 W and 550 W of halogen lamps are used. The heating roll 7 is controlled by a temperature sensor 15 to about 200° C., and at the time of start-up of the apparatus, start-up time of about 20 seconds is attained by lighting up both heating sources 12*a* and 12*b*.

Figure 3:
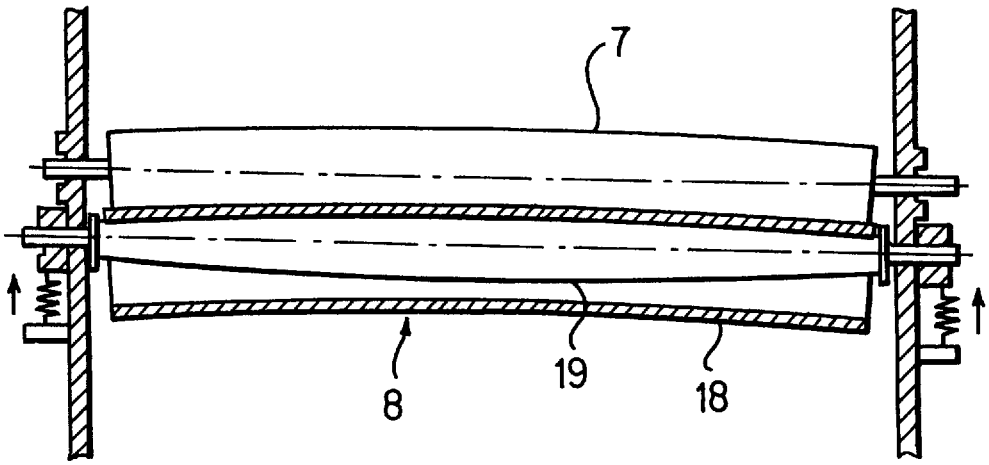
FIG. 3 is a schematic cross-sectional view showing the heating roll and the pressing member.

The pressing member 8 is arranged in the most downstream portion of a contact area A with the heating roll 7 in the rotational direction of the intermediate transfer member 5 to form a transfer fixing area B in a nip portion $P_b$ which is urged against the intermediate transfer member 5. The pressing member 8 is provided, as shown in FIG. 3, with a pressing rotatable member 18 consisting of a cylindrical member having a uniform cross-section axially, and a pressing roll 19 inserted inside the pressing rotatable member 18, for pressing the pressing rotatable member against the heating roll 7. The pressing roll 19 has a larger diameter at the central portion than the diameter of both ends thereof, and is so supported at both ends of the rotation shaft as to bias the pressing rotatable member 18 to the heating roll side. In this example, as the pressing rotatable member 18, there is used a member prepared by coating steel pipe having an external diameter of 30 mm, and thickness of 0.3 mm with heat-resistant hard resin such as polyimide and further forming a PFA resin layer of 20 $\mu$m on the surface thereof. Also, as the pressing roll 19, a roll prepared by forming tapering of 200 $\mu$m into a crown shape is used, and its outer peripheral surface is coated with hard silicone rubber with thickness of 1.0 mm. Thus, the nip portion $P_b$ between the intermediate transfer member 5 and the pressing rotatable member 18 has substantially uniform shape axially at 1.5 mm at the central portion and at 1.6 mm at both end portions thereof, and the pressing force of the pressing roll 19 is arranged to cause elastic deformation to the thermal insulating elastic body layer 13 of the heating roll 7. Also, for the dwell time during which the recording medium passes the nip portion $P_b$, it is set to 0.005 second.

For the toner for use with the image forming apparatus, there is used toner having a toner softening point temperature of 100° C., and a sharp-melt property using polyester resin as binding resin, which satisfies conditions of:

$T_1$=102° C. and $\Delta T=T_2-T_1$=10° C.

where assuming a temperature when apparent melt viscosity of $10^3$ Pa.s is indicated, is $T_1$, and a temperature, when apparent melt viscosity of $2\times10^2$ Pa.s is indicated, is $T_2$. In this respect, the softening point of toner was determined by a flow tester Model CFT-500A (manufactured by Shimadzu Seisakusho Ltd.).

Next, the description will be made of an image forming method which is an operation of the image forming apparatus, and is also an embodiment of the invention.

When an image forming operation is started, in the yellow image forming unit 30Y, the surface of the image carrier 1 is uniformly charged by the charging unit 2, and image light is applied to the surface of the image carrier 1 from the exposure unit 3 to form a latent image the surface of the image carrier 1. Thereafter, the latent image on the image carrier 1 passes an opposed location to the developing unit 4 containing yellow toner, and toner having charge within a development field is selectively transferred onto the image carrier 1 to visualize the latent image. At this time, the image light is applied to the image portion, and toner having the same polarity charge as the surface potential polarity of the image carrier 1 charged by the charging unit 2 is transferred onto the exposure portion of the image carrier 1 to form a toner image. This toner image is brought into contact with the peripheral surface of the intermediate transfer member 5 by the rotational movement of the image carrier 1, and the toner image is electrostatically adsorbed onto the intermediate transfer member 5 by the operation of the transfer roll 6 for primary transfer.

Similarly, in the magenta image forming unit 30M, the image carrier 1 is charged by the charging unit 2, and image light is irradiated from the exposure unit 3 to form a latent image corresponding to the magenta image on the image carrier 1. This latent image is developed by the developing unit 4 containing magenta toner to form a toner image of magenta. This toner image is transferred, superposed on top of the yellow toner image previously formed, on the intermediate transfer member 5 brought into contact with the image carrier 1.

Similarly thereafter, in the cyan image forming unit 30C,charging by the charging unit 2, application of image light from the exposure unit 3, and formation of a toner image by the cyan developing unit 4 are performed to transfer this toner image, superposed on top of the previous toner image, on the intermediate transfer member 5. Further, in the black image forming unit 30B, re-charging by the charging unit 2, application of image light from the exposure unit 3, and formation of a toner image by the black developing unit 4 are performed to transfer this toner image superposed on the intermediate transfer member 5.

Figure 4:
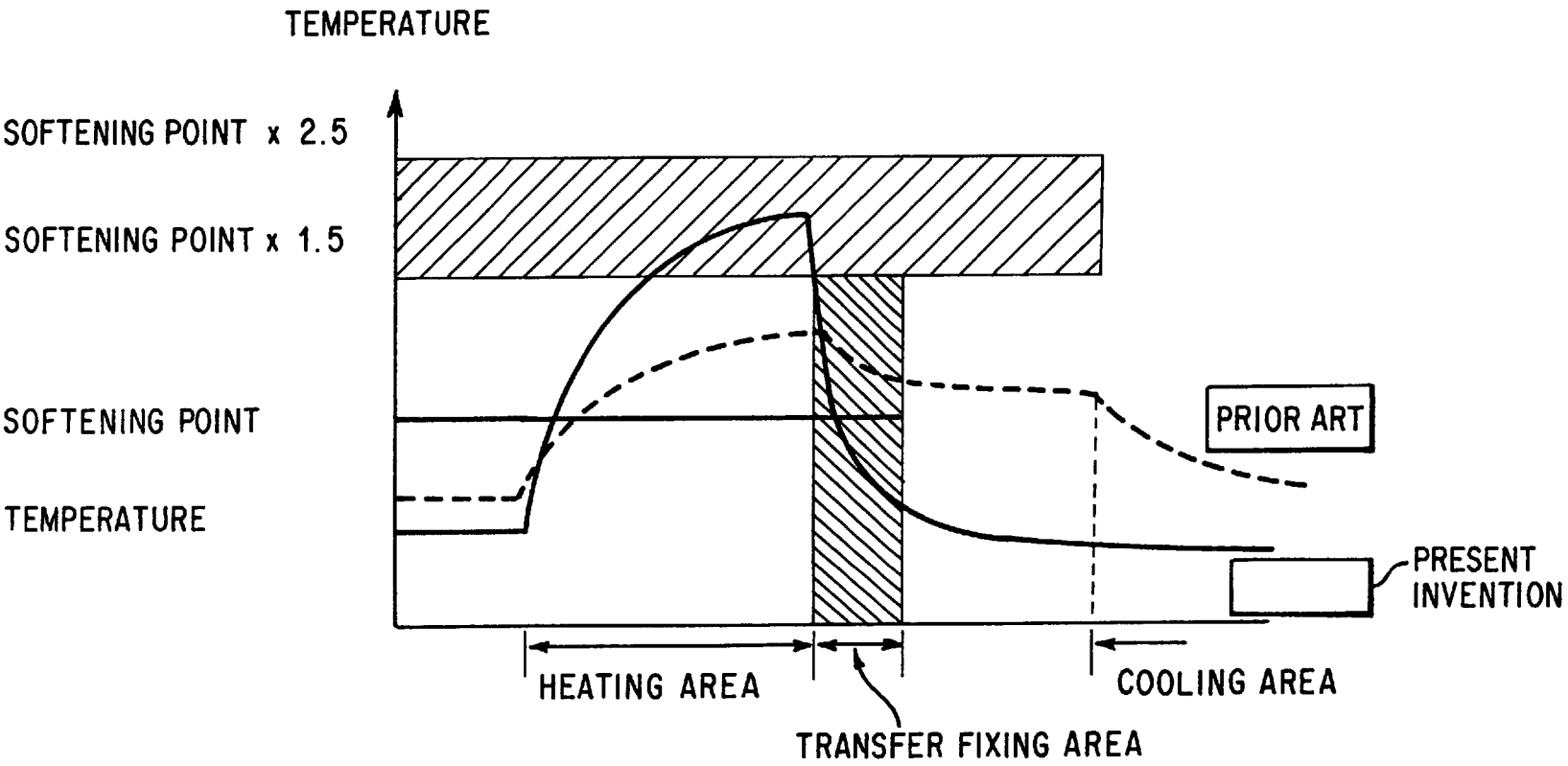
FIG. 4 is a view showing variations in toner temperature in a heating area and a transfer fixing area in the image forming apparatus.

When the primary transfer for the fourth color toner image is performed, the toner image transferred superposedly on the surface of the intermediate transfer member 5 is fed to the heating area A where the intermediate transfer member 5 and the heating roll 7 are brought into tight contact with each other. While passing this heating area A, heat is transferred from the heating roll 7 to the intermediate transfer member and the toner thereon. Then, the viscosity of the toner on the intermediate transfer member 5 deteriorates very sharply to cause adequate mixing between the top toner image and the bottom toner image, and further the transparence of the toner layer itself rapidly increases, thus causing good tone reduction mixing. The heating roll 7 is controlled to about 200° C. by the temperature sensor 15, and as shown in FIG. 4, the toner is heated to 200° C., about twice the toner softening point temperature which is equal to the set temperature of the heating roll 7 in the vicinity of the downstream heating area A. Thereafter, the toner image on the intermediate transfer member 5 is brought into contact with the recording medium at normal temperatures at the inlet of the transfer fixing area B to be pinched and urged against between the heating roll 7 and the pressing rotatable member 18. This operation cools and hardens the toner while percolating through the fiber of the recording medium to complete the transfer and fixing. At the outlet of the transfer fixing area B, the toner temperature becomes not more than the softening point temperature, and returns to the solid state with its cohesive power increased. Therefore, the toner transfers in a body from the intermediate transfer member 5 to the recording medium which has great adhesive power with toner to percolate through the fiber of the recording medium. Thus, the multi-color toner image on the intermediate transfer member 5 is transferred onto the recording medium and is fixed at the same time.

In the present embodiment, in the case where power consumption when continuous transfer and fixing are performed at a rate of 60 sheets (A4 size) per minute is analyzed, it is possible to transfer and fix a color image with 650 W in total by consuming 250 W for heating the intermediate transfer member 5, 250 W for heating toner (case of toner image in entire area), and 150 W for heat loss to the circumferences. Also, the maximum temperature of the recording medium after transfer and fixing is 50° C., and since toner temperature is not more than 50° C., the toner is in a solid state, which is combined with the compression deformation effect of the thermal insulating elastic body layer 13 to provide excellent separating performance. This compression deformation effect will be described later.

Further, since the surface of the intermediate transfer member 5 is coated with fluororesin, it has 2 high parting property. Also, since the cohesive power of the toner is great when separated from the recording medium, the toner hardly offsets to the intermediate transfer member 5 after the transfer.

The recording medium onto which the toner image has been transferred and fixed is separated from the intermediate transfer member 5 by a separating claw 17 downstream side of the nip portion $P_b$, and is discharged into a stacker (not shown) outside the apparatus.

On the other hand, since it has a small thermal capacity, the intermediate transfer member 5 will be cooled before the next image forming process. For this reason, the image carrier 1 is not affected by the heat of the intermediate transfer member 5, thus preventing the image quality from being deteriorated.

When a transfer and fixing test was conducted using such image forming apparatus, the high-quality color image having the substantially same level of luster as fixed with a mirror-finish soft roll was obtained on the recording medium after the transfer and fixing.

Also, in the image forming apparatus, since the amounts of heating for the recording medium and the intermediate transfer member are very small, the power consumption can be restricted to a minimum. For example, it was confirmed that it is possible to transfer and fix 80 to 100 sheets and over (A4 size) per minute in a black-and-white copying apparatus, and 60 to 80 sheets and over (A4 size) per minute in a color copying apparatus with electric power of 600 W to 800 W.

Next, a graph illustrated in FIG. 4 shows the results for fixing characteristics of toner image and occurrence state of offset when the thermal capacity of the intermediate transfer member and the heating temperature are varied in an image forming apparatus of the present embodiment.

Here, the lower limit value for thickness for determining the thermal capacity of the intermediate transfer member is determined by the mechanical strength, and the thickness of the intermediate transfer member needs to be not less than 10 μm because rumples or turned-up end portions easily occur when the thickness thereof is below 10 μm.

According to the experiment, it can be seen that if the heating temperature is selected within a range of shaded portion of 1.5 times to 2.5 times the toner softening point temperature when the thickness of the intermediate transfer member is 10 μm and over to 40 μm inclusive., no offset occurs but sufficient fixing characteristics can be obtained. At this time, the thermal capacity of the intermediate transfer member is 1/10 and over to ½ inclusive. that (about 7.2 joule/°C.) of the recording medium. Also, although not described in the graph of FIG. 4, if the heating temperature is not more than 1.5 times the toner softening point, the transfer and fixing characteristics cannot be satisfied within the above-described range of thickness of the intermediate transfer member, and also if the heating temperature exceeds 2.5 times, offset occurs when the thickness of the intermediate member is about 50 μm.

Figure 5B:
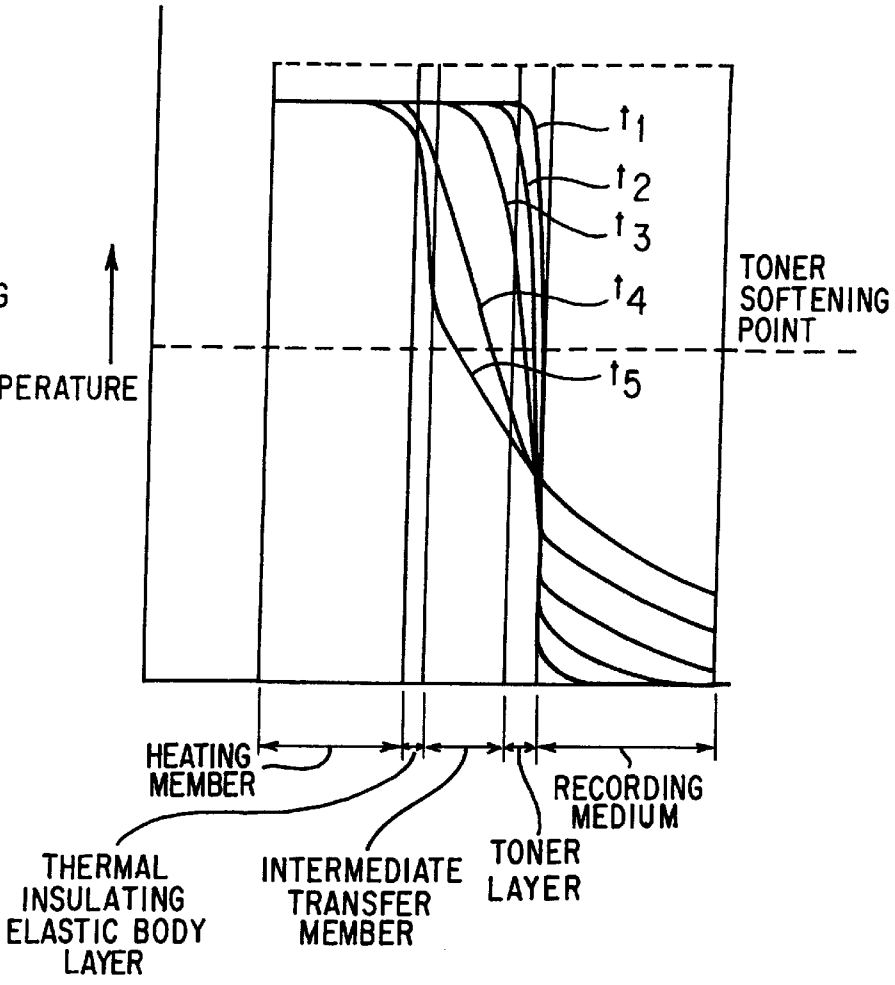
FIG. 5 is a view showing temperature distribution on the heating roll, intermediate transfer member, toner and recording medium in the transfer fixing area in the image forming apparatus in comparison with a case where no thermal insulating elastic body layer is provided.
Figure 5A:
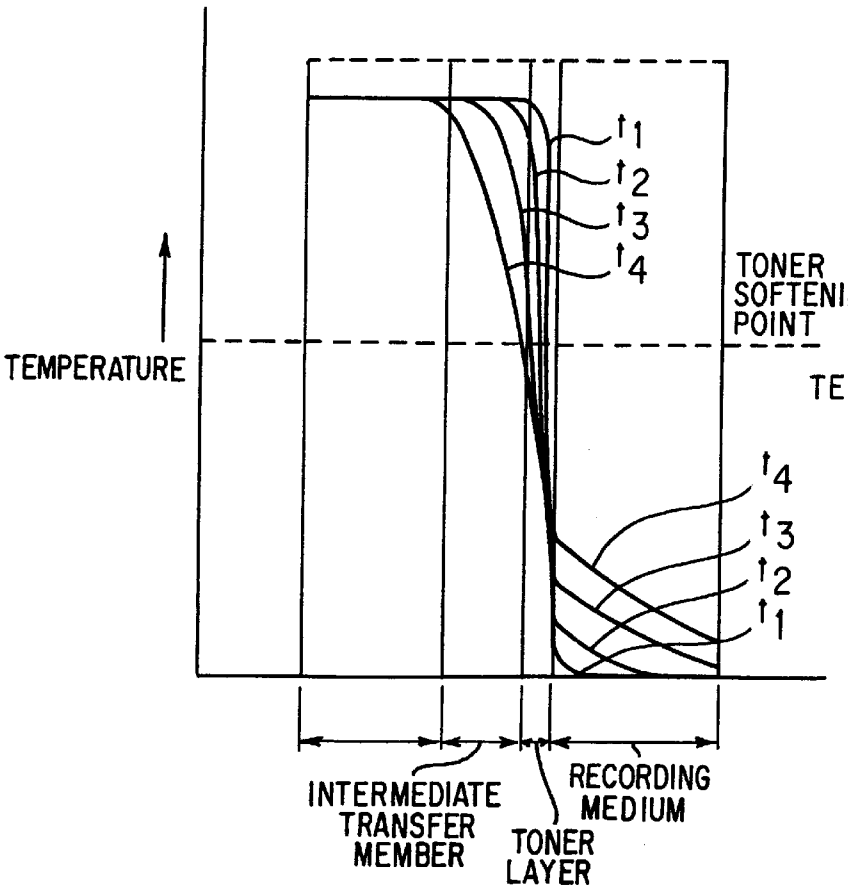

FIG. 5A is a view showing temperature distribution of toner, intermediate transfer member and recording medium in a transfer fixing area in the present image forming apparatus, and FIG. 5B is a view showing temperature distribution when no thermal insulating elastic body layer on the surface of a heating roll is used, as a comparative example of the image forming apparatus.

From FIG. 5A, it can be seen that in the transfer fixing area, the temperature of the intermediate transfer member and toner on the surface thereof suddenly lowers, and there is no heat conduction from the heating roll to the intermediate transfer member by means of the thermal insulating elastic body layer on the surface of the heating roll. Namely, the thermal energy for effecting the transfer and fixing is applied only in the heating area, and in the transfer fixing area, the toner comes into contact with the recording medium at normal temperatures to be cooled to not more than the toner softening point temperature in an exceedingly short time.

On the other hand, if no thermal insulating elastic body layer is used as shown in FIG. 5B, when the lowered temperature of the intermediate transfer member and the toner advances in the transfer and fixing area, the surface temperature of the heating roll lowers to cause heat conduction from the heating roll to the intermediate transfer member and the toner. Therefore, although the toner comes into contact with the recording medium at normal temperatures to lower its temperature, the heat accumulated at the heating roll and the heat supplied from the heating source will be transmitted to the toner and the recording medium. Accordingly, the temperature of the toner and the recording medium becomes higher at the outlet of the transfer fixing area, and it becomes difficult to set the toner temperature to not more than the softening point temperature.

Figure 6:
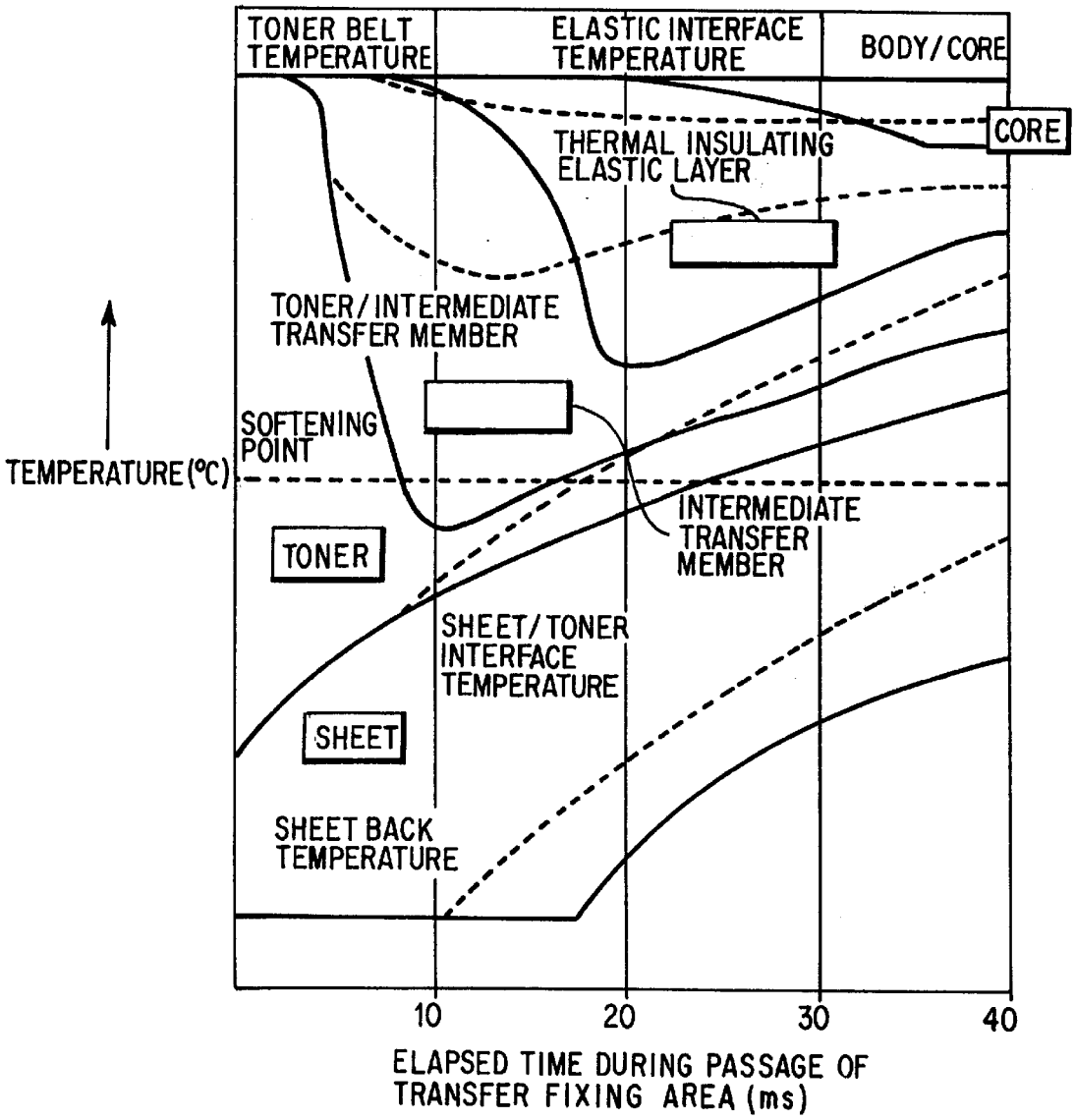
FIG. 6 is a view showing relationship between transfer fixing time and temperature of the intermediate transfer member and toner on its surface in the image forming apparatus in comparison with a case where no thermal insulating elastic body layer is formed.

Also, FIG. 6 is a view showing relationship between transfer fixing time and temperature of toner on the intermediate transfer member when a thermal insulating elastic body layer is provided as compared with when no thermal insulating elastic body layer is provided.

From this figure, it is confirmed that while the temperature of the toner becomes not more than the softening point temperature in about 10 ms in transfer fixing time when a thermal insulating elastic body layer is provided, the toner temperature in the vicinity of the intermediate transfer member interface will not fall when no thermal insulating elastic body layer is provided.

In this respect, in a conventional two-roll type image forming apparatus for urging a pressing roll against a heating roll, while the temperature of the fixing roll and the heating roll for effecting sufficient fixing is 1.0 times to about 1.5 times the toner softening point, it is necessary in this embodiment to heat at a temperature higher than it. This is because while in the conventional apparatus, preliminary heating is effected in the heating area and the intermediate transfer member and the toner thereon are further heated and pressurized in the transfer fixing area thereafter, in this embodiment, the energy for effecting transfer and fixing is applied only in the heating area, and any thermal energy is not transmitted practically from the heating member in the transfer fixing area.

Figure 7:
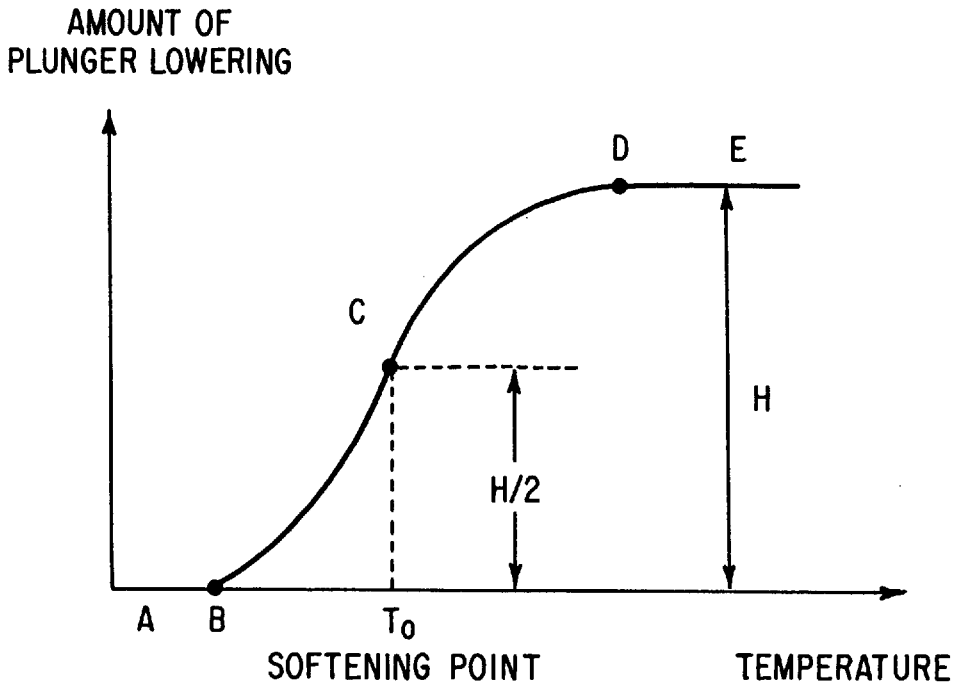
FIG. 7 is an explanatory view for showing a measuring method for softening point of toner for use with the image forming apparatus.
Figure 8A:
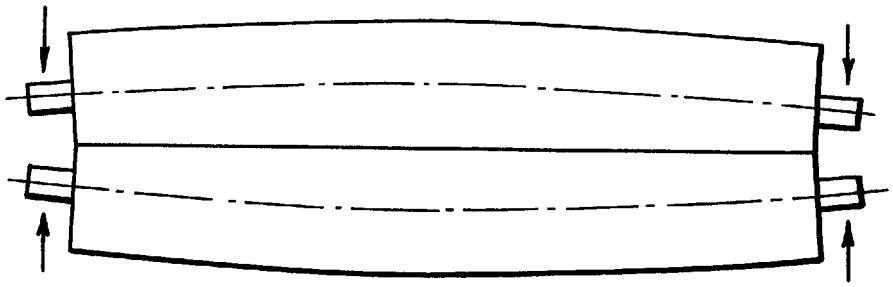
FIG. 8 is a view showing a shape of the pressure-contact portion between a heating roll and a pressing roll which is a problem of the conventional image forming apparatuses.
Figure 8B:
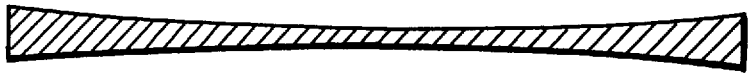

Also in a conventional two-roll type image forming apparatus for urging a pressing roll against a heating roll, a period of time required for raising the surface temperature of the heating roll to a predetermined set temperature from room temperature, i.e., warm up time requires as long time as three to five minutes. This warm up time is simply determined by relationship between the thermal capacity of the heating roll and making power. Namely, if the heating roll has a small thermal capacity and the making power is great, the warm up time can be shortened, but there are limits to the thermal capacity of the heating roll and the making power because of restrictions on the rigidity of the heating roll and on the power consumption of the machines respectively. Generally, the power applicable to the heating roll is 600 to about 800 W, and in order to shorten the warm up time within this range, it is effective to reduce the thermal capacity of the roll. When, however, the external diameter of the heating roller and the thickness of the mandrel are reduced to reduce the thermal capacity of the heating roll, the rigidity of the heating roll will be also reduced at the same time. To this end, when the heating roll and the pressing roll are brought into press contact with each other while supported on both end portions, the central shafts of the rolls are deflected in the opposite direction to each other as shown in FIG. 7A, and the nip portion between both rolls becomes wide at the both ends of the rolls, narrow at the central portion thereof, and has an ununiform shape. If an intermediate transfer member or a recording medium is caused to pass the nip portion of such a ununiform shape, rumples may occur, or the pressing strength at the central portion of the recording medium is weak to cause offset, thus possibly contaminating the next recording supporting member or lacking in an image. Here, when assuming the nip width at the central portion of the roll to be a, and the nip width at both end portions to be b, a nip shape index at the central portion is defined as $\underline{c}=a/b$, the nip shape index $\underline{c}$ becomes smaller than 1.0 by the deflection of the roll. The optimum value of c is generally 0.8 to 1.0 in terms of the uniformity of pressing strength, avoidance of rumples and the like.

In the conventional apparatus, however, when the thermal capacity of the heating roll is reduced to shorten the warm up time, the deflection of the roll when a necessary contacting force is introduced increases due to the deteriorated rigidity, and the value of c decreases to be beyond the above-described optimum range. Accordingly, in order to avoid the nip width from being uneven, it becomes necessary to so maintain the rigidity as to suppress the deflection of the roll not more than a certain level, or to correct the distribution of the contacting power of the roll. In the case of suppressing such amount of deflection, the standard for the limit is about 0.1 mm, and it is mostly difficult to reduce the deflection to not more than this value.

On the other hand, an image forming apparatus of the present embodiment is provided with a pressing rotatable member 18 consisting of a cylindrical member having a substantially uniform cross-section axially, and a pressing roll 19 for supporting the pressing rotatable member from the interior of this cylindrical member, and adopts a mechanism in which the pressing rotatable member 18 is pressed against the heating roll by the contacting force of the pressing roll. Since this pressing roll has a larger diameter at the central portion than diameters at both end portions, the pressing rotatable member has such a shape as to follow the deflection curve of the heating roll even if the side to be pressed so deflects as to become recessed near the central portion of the heating roll so that the contacting force between the pressing rotatable member and the heating roll is maintained substantially uniform axially. To this end, it is possible to set the nip shape index to 0.8 to 1.0 even if the thermal capacity of the heating roll is reduced. Thereby, the occurrence of defective fixing is prevented, and further the speed of the pressing rotatable member on the peripheral surface becomes substantially uniform axially, and therefore, the direction of the recording medium becomes appropriate, thus preventing rumples from occurring on the intermediate transfer member and the recording medium.

Also, the present embodiment adopts such a structure that the heating roll 7 has a thermal insulating elastic body layer on the surface of a side pressed against by the intermediate transfer member 5 and the pressing roll 19 presses the intermediate transfer member 5 against the heating roll 7 to cause compression deformation to the elastic body layer 13. This structure easily separates the recording medium for the following reason.

If no thermal insulating elastic body layer is provided on the surface of the heating roll, when a recording medium is fed into the transfer and fixing nip portion, the toner melted by heating and pressurizing is brought into tight contact with the intermediate transfer member together with the recording medium. If, however, compression deformation has occurred in the elastic body layer 13 on the heating roll as in the present embodiment, micro slip occurs on the recording medium when the elastic body layer thus deformed is restored at the outlet of the nip portion. This micro slip causes the recording medium to be easily separated from the intermediate transfer member. Effect of the Invention:

As described above, according to an image forming apparatus and an image forming method according to the present invention, a toner image on the intermediate transfer member is heated in a heating process, and the toner image is urged against a recording medium at normal temperatures in an area continuous to the area where the heating process is effected. Therefore, the recording medium serves as a cooling member, and it becomes possible to transfer and fix the toner image on the recording medium in a moment. To this end, it is possible to sufficiently lower the toner temperature when the recording medium is separated from the intermediate transfer member, and to prevent offset from occurring, thus obtaining a satisfactory image having good fixing characteristics. Also, since the toner image on the intermediate transfer member is melted, thermal energy is actually applied only in the heating process, and the toner image can be transferred and fixed without causing heat conduction from the heating member to the intermediate transfer member in the transfer fixing process, thus securing an image forming apparatus having good energy efficiency. Further, this apparatus has concretely the following merits, and their utilization value is great.

(1) Total consumption energy is small, and high-speed image formation can be performed with limited power.

(2) Since the recording medium serves as a cooling member to suddenly lower the temperature of the intermediate transfer member, no obstruction is caused on the image carrier side. Further, there is no need for a cooling process which has been required for the conventional transfer and fixing device, and the apparatus becomes compact.

(3) By the formation of a thermal insulating elastic body layer on the surface of the heating member, there can be obtained a transfer and fixing image of the same high quality as the image quality fixed by a fixing device using a conventional soft roll.

(4) Since no offset phenomenon occurs even in sharp-melt toner easy to offset, it can be sufficiently applied to not only black-and-white copying apparatuses but also color copying apparatuses.

(5) Since an amount of heating for a recording medium is very small, the transfer fixing characteristics are hardly affected by the thickness and the thermal capacity of a recording medium, and further curl or paper rumple hardly occurs. (6) The warm up time can be greatly shortened, and as a result, the power supplied to maintain the heating member at set temperature during stand-by can be eliminated.

What is claimed is:

1. An image forming apparatus, comprising:

an image carrier on which a toner image is formed on a peripheral surface thereof;

an endless-like intermediate transfer member so supported as to allow a peripheral surface to rotate and move, on the outer peripheral surface of which said toner image is transferred;

a first transfer unit for transferring the toner image on said image carrier onto said intermediate transfer member;

a heating member for heating the toner image transferred onto said intermediate transfer member to a temperature not less than 1.5 times a softening point temperature in °C. of said toner;

a recording medium; and a second transfer unit for urging said recording medium against the toner image heated by said heating member in a predetermined area of said intermediate transfer member in the rotational direction, and transferring and fixing said toner image onto said recording medium while lowering the temperature of said toner image in such a manner that the temperature of said toner image at the outlet of said predetermined area is not more than the toner softening point temperature in °C.

2. An image forming apparatus according to claim 1, wherein said heating member heats the toner image transferred onto said intermediate transfer member at 1.5 times and over to 2.5 times inclusive the toner softening point temperature in °C.

3. An image forming apparatus according to claim 1, wherein the length of said predetermined area in said intermediate transfer member in the rotational direction thereof is set to such length that the temperature of the toner image at the outlet of said predetermined area becomes not more than the toner softening point temperature in °C.

4. An image forming apparatus according to claim 2, wherein the length of said predetermined area in said intermediate transfer member in the rotational direction thereof is set to such length that the temperature of the toner image at the outlet of said predetermined area becomes not more than the toner softening point temperature in °C.

5. An image forming apparatus according to claim 1, wherein a separating member for separating said recording medium from said intermediate transfer member is further provided on the downstream side of said predetermined area.

6. An image forming apparatus according to claim 2, wherein a separating member for separating said recording medium from said intermediate transfer member is further provided on the downstream side of said predetermined area.

7. An image forming apparatus according to claim 1, wherein the thermal capacity per unit area of said intermediate transfer member is smaller than half the thermal capacity per unit area of said recording medium.

8. An image forming apparatus according to claim 2, wherein the heat capacity per unit area of said intermediate transfer member is smaller than half the thermal capacity per unit area of said recording medium.

9. An image forming apparatus, comprising:

an image carrier on which a toner image is formed on a peripheral surface thereof;

an endless-like intermediate transfer member so supported as to allow a peripheral surface to rotate and move, on the outer peripheral surface of which said toner image is transferred;

a first transfer unit for transferring a toner image on said image carrier onto said intermediate transfer member;

a heating member so supported as to come into contact with the inner peripheral surface of said intermediate transfer member, for heating the toner image transferred onto said intermediate transfer member to a temperature not less than 1.5 times a softening point temperature in °C. of said toner;

a recording medium; and a pressing member for pressing said recording medium, which is pressed against said intermediate transfer member and is fed between said intermediate transfer member and said pressing member, against said intermediate transfer member in the most downstream portion of a contact area with said heating member in the rotational direction of said intermediate transfer member, a period of time during which said recording medium passes a pressure-contact portion between said pressing member and said intermediate transfer member being set in such a manner that the temperature of the toner image at the outlet of said pressure-contact portion becomes not more than the toner softening point temperature in °C.

10. An image forming apparatus according to claim 9, wherein said heating member heats the toner image transferred onto said intermediate transfer member at 1.5 times and over 2.5 times inclusive the toner softening point temperature in °C.

11. An image forming apparatus according to claim 9, wherein said heating member has a heating source arranged inside a cylindrical member, and a thermal insulating elastic body layer formed on the outer peripheral surface of said cylindrical member.

12. An image forming apparatus according to claim 11, wherein said pressing member is so supported as to cause elastic deformation in said thermal insulating elastic body layer when said pressing member is urged against said heating member through said intermediate transfer member.

13. An image forming apparatus according to claim 9, wherein the heat capacity per unit area of said intermediate transfer member is smaller than half the thermal capacity per unit area of said recording medium.

14. An image forming apparatus according to claim 11, wherein the thermal capacity per unit area of said intermediate transfer member is smaller than half the heat capacity per unit area of said recording medium.

15. An image forming apparatus according to claim 9, wherein toner constituting said toner image is sharp melt toner having a softening point of 80° C. to 125° C. which satisfies relation of $T_2-T_1=5°$ C. to 20° C. assuming temperature indicating apparent melting velocity of $10^3$ Pa.s to be $T_1$, and temperature indicating apparent melting velocity of $2\times10^2$ Pa.s to be $T_2$.

16. An image forming apparatus according to claim 9, wherein said pressing member has a cylindrical pressing rotatable member having a uniform cross-section axially, and a pressing member inserted inside said pressing rotatable member, and supported on both ends thereof, for urging said pressing rotatable member against said heating member through said intermediate transfer member, and wherein said pressing member has a larger diameter at the central portion thereof than a diameter at both ends thereof in such a manner that a contacting force between said pressing rotatable member and said heating member becomes substantially uniform axially.

17. An image forming method for forming a toner image on an image carrier, primarily transferring said toner image onto an intermediate transfer member so supported as to rotate, and secondarily transferring and fixing the toner image on said intermediate transfer member collectively onto a recording medium, comprising the steps of:

heating the toner image on said intermediate transfer member at a temperature not less than 1.5 times the toner softening point temperature in °C.;

urging the toner image on said intermediate transfer member heated in said heating step against said recording medium, transferring and fixing said toner image onto said recording medium; and setting a period of time during which said recording medium passes said transfer and fixing step in such a manner that said toner immediately after said transfer and fixing step is cooled by said recording medium and the temperature of said toner becomes not more than the toner softening point temperature in C.

18. An image forming method according to claim 17, wherein said heating step heats said toner image on said intermediate transfer member at 1.5 times and over to 2.5 times inclusive the toner softening point temperature in °C.

19. An image forming method according to claim 17, further comprising a separating step of separating said recording medium from said intermediate transfer member after said transfer and fixing step.

20. An image forming method according to claim 17, wherein the heat capacity per unit area of said intermediate transfer member is smaller than half the heat capacity per unit area of said recording medium.

* * * * *